US009184495B2

(12) United States Patent
Kataoka et al.

(10) Patent No.: US 9,184,495 B2
(45) Date of Patent: Nov. 10, 2015

(54) VEHICULAR ANTENNA APPARATUS

(71) Applicants: DENSO CORPORATION, Kariya, Aichi-pref. (JP); Nippon Soken, Inc., Nishio, Aichi-pref. (JP)

(72) Inventors: Ryohei Kataoka, Okazaki (JP); Tadao Suzuki, Kariya (JP); Yuji Sugimoto, Kariya (JP)

(73) Assignees: DENSO CORPORATION, Kariya, Aichi-pref. (JP); NIPPON SOKEN, INC., Nishio, Aichi-pref. (JP)

( * ) Notice: Subject to any disclaimer, the term of this patent is extended or adjusted under 35 U.S.C. 154(b) by 274 days.

(21) Appl. No.: 13/975,730

(22) Filed: Aug. 26, 2013

(65) Prior Publication Data

US 2014/0062808 A1 Mar. 6, 2014

(30) Foreign Application Priority Data

Sep. 3, 2012 (JP) ..... 2012-193249

(51) Int. Cl.
*H01Q 1/32* (2006.01)
*H01Q 1/40* (2006.01)

(52) U.S. Cl.
CPC ..... *H01Q 1/32* (2013.01); *H01Q 1/3275* (2013.01); *H01Q 1/40* (2013.01)

(58) Field of Classification Search
CPC ..... H01Q 1/32; H01Q 1/3275
USPC ..... 343/711–713
See application file for complete search history.

(56) References Cited

U.S. PATENT DOCUMENTS

| | | | | |
|---|---|---|---|---|
| 2008/0012776 | A1* | 1/2008 | Blickle | 343/713 |
| 2008/0117111 | A1* | 5/2008 | Ikeda et al. | 343/713 |
| 2011/0298677 | A1* | 12/2011 | Petrucci et al. | 343/713 |
| 2012/0081256 | A1 | 4/2012 | Aizawa et al. | |
| 2012/0299794 | A1 | 11/2012 | Sugimoto et al. | |
| 2013/0050034 | A1* | 2/2013 | Wu et al. | 343/713 |

FOREIGN PATENT DOCUMENTS

| | | |
|---|---|---|
| JP | 2012-080388 | 4/2012 |
| JP | 2012-249089 | 12/2012 |
| WO | WO 2013/153770 | 10/2013 |

* cited by examiner

*Primary Examiner* — Dameon E Levi
*Assistant Examiner* — Hasan Islam
(74) *Attorney, Agent, or Firm* — Harness, Dickey & Pierce, P.L.C.

(57) ABSTRACT

A vehicular antenna apparatus includes a substrate, a circuit portion, a case, and a heat transfer path. The substrate has an antenna portion. The circuit portion is mounted on the substrate and configures at least a part of a wireless communication circuit electrically coupled with the antenna portion. The case is made of resin material and configures a protruded portion of an outer surface of a vehicle. The substrate and the circuit portion are arranged in the case. The heat transfer path is arranged between the circuit portion and the case, and has a thermal conductivity higher than air. The circuit portion is electrically coupled with the antenna portion by a solid phase diffusion bonding.

7 Claims, 4 Drawing Sheets

VEHICULAR ANTENNA APPARATUS

CROSS REFERENCE TO RELATED APPLICATION

This application is based on Japanese Patent Application No. 2012-193249 filed on Sep. 3, 2012, the disclosure of which is incorporated herein by reference.

TECHNICAL FIELD

The present disclosure relates to a vehicular antenna apparatus, and particularly relates to a vehicular antenna apparatus used in vehicle-to-vehicle communication and road-to-vehicle communication.

BACKGROUND

As disclosed in JP 2012-80388 (corresponding to US 2012/0081256 A), a conventional antenna apparatus includes an antenna cover (hereinafter referred to as a case) in which a global positioning system (GPS) antenna, a digital television (DTV) antenna, a radio antenna are arranged. The antenna cover is protruded from an outer surface of a vehicle body.

In an antenna apparatus, a transmission loss in a transmission cable increases with an increase of a frequency of a radio wave utilized for a communication. The frequency of the radio wave is set for an intended application of the antenna apparatus. Specially, in an antenna apparatus used for a vehicle-to-vehicle communication and a road-to-vehicle communication, the radio wave utilized for the communication has a high frequency range of, for example, within a 5.9 gigahertz (GHz) band. Thus, the antenna apparatus has a large transmission loss. In order to reduce the transmission loss in the antenna apparatus, antenna elements may be arranged adjacent to a circuit portion, which configures at least a part of a wireless communication circuit. For example, the antenna elements and the circuit portion may be arranged on the same substrate.

In the antenna apparatus disclosed in JP 2012-80388, when the circuit portion is arranged on the substrate, the circuit portion is arranged in the case together with the substrate. Thus, heat generated by the circuit portion is accumulated in an inside space of the case without being released to an outside of the case. Thus, a performance of the circuit portion may be degraded. Specifically, when the case is arranged on a vehicle roof, the performance may degrade more easily by radiated solar heat. Since the case configures a part of the outer surface of the vehicle body, use of a cooling fun and opening a vent hole are limited by a design limitation.

Further, a thermal stress against a usage environment, a vibration of the vehicle, a stress generated in assembling of the substrate including the circuit portion to the case are applied to a coupling portion between the circuit portion and the antenna elements. Thus, a required lifetime of the coupling portion may be not secured due to the above-described reasons.

SUMMARY

In view of the foregoing difficulties, it is an object of the present disclosure to provide a vehicular antenna apparatus in which a performance degradation of a circuit portion is restricted and a lifetime of a coupling portion between the circuit portion and an antenna portion is improved.

According to an aspect of the present disclosure, a vehicular antenna apparatus includes a substrate, a circuit portion, a case, and a heat transfer path. The substrate has an antenna portion. The circuit portion is mounted on the substrate and configures at least a part of a wireless communication circuit electrically coupled with the antenna portion. The case is made of resin material and configures a protruded portion of an outer surface of a vehicle. The substrate and the circuit portion are arranged in the case. The heat transfer path is arranged between the circuit portion and the case, and has a thermal conductivity higher than air. The circuit portion is electrically coupled with the antenna portion by a solid phase diffusion bonding.

With the above vehicular antenna apparatus, the antenna portion is arranged adjacent to the circuit portion. Thus, when the utilized radio waves are within a high frequency range, the transmission loss is restricted. Thus, a performance of the vehicular antenna apparatus is improved when used in the vehicle-to-vehicle communication and the road-to-vehicle communication.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

The following will describe embodiments of the present disclosure with reference to the drawings.

Figure 1:
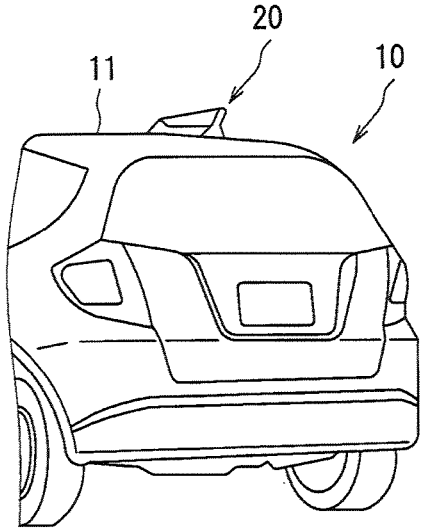
FIG. 1 is a diagram showing an attachment position of a vehicular antenna apparatus according to an embodiment of the present disclosure.

As shown in FIG. 1, a vehicular antenna apparatus 20 according to the present embodiment is attached to a roof 11 of a vehicle 10. The vehicular antenna apparatus 20 shown in FIG. 1 is also known as a shark-fin antenna apparatus. Hereinafter, the vehicular antenna apparatus 20 is referred to as antenna apparatus 20 for convenience of description.

Figure 2:
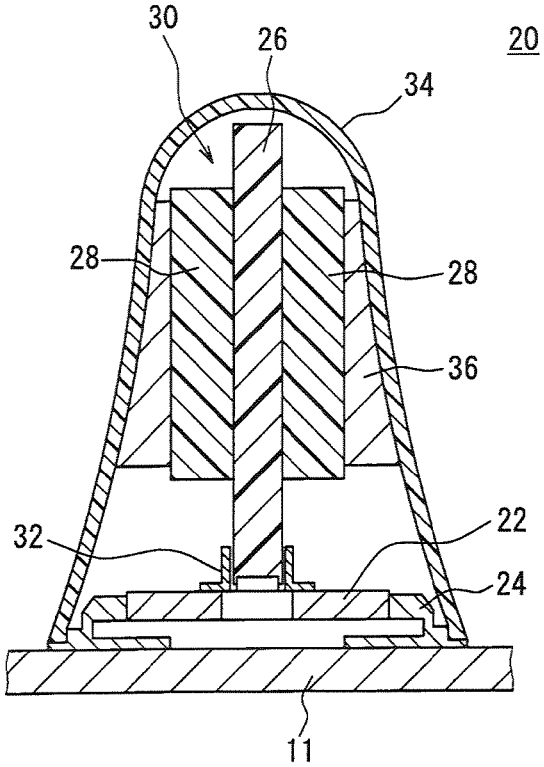
FIG. 2 is a diagram showing a cross-sectional view of the vehicular antenna apparatus.

As shown in FIG. 2, the antenna apparatus 20 mainly includes a base 22, an antenna unit 30, and a case 34. The antenna unit 30 includes a substrate 26 arranged in a standing manner on the base 22 and a circuit portion 28 attached to the substrate 26. The case 34 is made of resin material, and configures a protruded portion of an outer surface of the vehicle 10. That is, the case 34 is arranged on the outer surface of the vehicle 10 and protrudes from the outer surface of the vehicle 10.

The base 22 fixes the substrate 26 to the vehicle 10. In the present embodiment, the base 22 is fixed to the roof 11 via a fixing member 24. The base 22 has a plate shape, and is approximately parallel to the roof 11. The base 22 has a first surface on which the substrate is arranged and a second surface positioned near the roof 11. The base 22 functions as a ground plate when being electrically coupled to the roof 11 via the fixing member 24. Whether to use the base 22 as the ground plate is decided corresponding to an application of the antenna apparatus 20.

Figure 3:
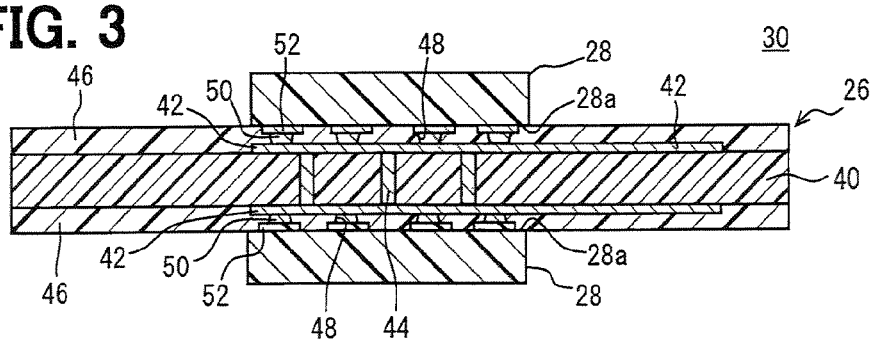
FIG. 3 is a diagram showing a configuration of an antenna unit of the vehicular antenna apparatus.

As shown in FIG. 3, the substrate 26 includes an antenna portion 42. In FIG. 2, the antenna portion 42 is not shown. Hereinafter, a radio wave utilized for a communication in an antenna apparatus is referred to as a utilized radio wave. In the present embodiment, for example, the antenna portion 42 is provided by an antenna, which is used for a vehicle-to-vehicle communication. Usually, a frequency range of the radio waves for the vehicle-to-vehicle communication is within 5.9 GHz band.

The substrate 26 may be provided by a printed substrate including a wiring pattern. The antenna portion 42 may be provided by a part of the wiring pattern of the printed substrate. As shown in FIG. 3, the substrate 26 further includes a base layer 40 made of electrically insulating material. The electrically insulating material may include thermoplastic resin and thermoplastic resin in which glass fiber and aramid fiber are impregnated. In the present embodiment, the base layer 40 is made of glass epoxy.

The antenna portion 42 is arranged on one surface of the base layer 40. Further, the antenna portion 42 may be arranged on both surfaces of the base layer 40. The antenna portion 42 may be provided by a part of the wiring pattern. The following will describe an example in which the antenna portion 42 is formed on both surfaces of the base layer 40. When one of the two surfaces of the base layer 40 is referred to as a first surface, the other surface is referred to as a second surface. As shown in FIG. 3A, copper foils are arranged on both surfaces of the base layer 40, and the antenna portion 42 is formed by patterning a part of the copper foils arranged on the base layer. A part of the antenna portion 42 arranged on the first surface of the base layer 40 is electrically coupled with the other part of the antenna portion 42 arranged on the second surface of the base layer 40 by via holes 44 extending through the base layer 40. Hereinafter, the part of the antenna portion 42 arranged on the first surface of the base layer 40 is referred to as a first part, and the part of the antenna portion 42 arranged on the second surface of the base layer 40 is referred to as a second part. In the present embodiment, each of the first part and the second part of the antenna portion 42 includes a monopole antenna element and a wide section. The wide section is connected to an end of the antenna element and functions as a ground. The wide section of the first part of the antenna portion 42 is electrically coupled with the wide section of the second part of the antenna portion 42 through the via holes 44.

Further, a thermoplastic resin layer 46 is arranged on each of the first surface and the second surface of the base layer 40 so that the antenna portion 42 is covered by the thermoplastic resin layer 46. The thermoplastic resin layer 46 may be bonded to each of the first surface and the second surface of the base layer 40. Specifically, the thermoplastic resin layer 46 is formed by softening and bonding specific resin material to the base layer 40 at a predetermined temperature under a condition that a thermal decomposition does not occur in the base layer 40 at the predetermined temperature. The bonding of the specific resin material to the base layer 40 may be performed by a thermocompression bonding. In the present embodiment, the thermoplastic resin layer 46 is provided by polyetherimide as an example. Further, in the present embodiment, entire first surface and entire second surface of the base layer 40 are covered by the thermoplastic resin layers 46.

The thermoplastic resin layer 46 defines through-holes 48 at predetermined positions. The number of the through-holes may be set as one or more, and the through-holes are also referred to as a through-hole portion 48. A coupling element 50 is disposed in each of the through-holes 48 in order to electrically couple the antenna portion 42 with electrodes 52 of the circuit portion 28. The one or more coupling elements 50 are also referred to as a coupling member 50. In the present embodiment, the coupling member 50 is made of silver-tin (Ag—Sn) alloy mainly including $Ag_3Sn$. Further, since the antenna portion 42 is made of copper (Cu) and the coupling member is made of Ag—Sn alloy, a solid phase diffusion layer (Cu—Sn alloy layer) in which Cu and Sn are mutually diffused is arranged on a boundary face between the antenna portion 42 and the coupling member 50.

The circuit portion 28 is mounted on a surface of the substrate 26. In the present embodiment, as shown in FIG. 3, the circuit portion 28 is mounted on both surfaces of the substrate 26. The circuit portion 28 is electrically coupled with the antenna portion 42 and configures at least a part of a wireless communication circuit through which an in-vehicle device communicates with an external device via the antenna portion 42. The wireless communication circuit is electrically coupled with the antenna portion 42. In the present embodiment, the circuit portion 28 includes a power amplifier that amplifies a signal to be transmitted to the external device through the antenna portion 42. The circuit portion 28 may further include a low-noise amplifier that amplifies a signal received from the external device. The circuit portion 28 may further include a switch that switches a power supply line to a transmission side or a receiving side. The circuit portion 28 may further include a band-pass filter arranged on the transmission side and a band-pass filter arranged on the receiving side. In the present embodiment, the circuit portion 28 configures a part of the wireless communication circuit. Further, the circuit portion 28 may include entire wireless communication circuit.

The circuit portion 28 may be provided by a circuit substrate that includes a printed substrate and electronic components mounted on the printed substrate, a semiconductor chip package in which electronic components are arranged, or a single semiconductor chip on which a circuit is integrated. In the present embodiment, the circuit portion 28 is provided by the semiconductor chip package formed by molding. The circuit portion 28 is arranged corresponding to the wide section of each of the first part and the second part of the antenna portion 42. The circuit portion 28 includes the electrodes 52 arranged on a surface 28*a* positioned opposed to the surface of the substrate 26. The surface 28*a* of the circuit portion 28 and the surface of the substrate 26 opposed to each other are also referred to as opposing surfaces. The electrodes 52 are arranged on the opposing surface 28*a* of the circuit portion 28 corresponding to the coupling member 50. Each of the electrodes 52 may include nickel (Ni) at least in a surface portion. Further, as described above, the coupling member 50 is made of Ag—Sn alloy. Thus, a solid phase diffusion layer (Ni—Sn alloy layer) in which Ni and Sn are mutually diffused is arranged on a boundary face between the electrodes 52 of the circuit portion 28 and the coupling member 50.

Further, thermoplastic resin layer 46 is contacted with the opposing surface 28*a* of the circuit portion 28 that is positioned opposed to the substrate 26. Thus, the antenna portion 42, the electrodes 52 of the circuit portion 28, and the coupling member 50, which electrically couples the antenna portion 42 with the electrodes 52 of the circuit portion 28, are sealed by the thermoplastic resin layer 46.

The antenna unit 30 is fixed to the base 22 via a fixing member 32. Specifically, the substrate 26 having the circuit portion 28 is fixed on the base 22 via the fixing member 32. That is, the substrate 26 is arranged in a standing manner on the base 22. In the present embodiment, the arrangement of the substrate 26 in a standing manner on the base 22 signifies that the substrate 26 is arranged so that a direction perpendicular to the surfaces of the substrate 26 on which the circuit portion 28 is arranged is different from a direction perpendicular to the first surface of the base 22. Specifically, the direction perpendicular to the first surface of the base 22 is a direction in which a thickness of the base 22 extends. In the present embodiment, the substrate 26 is fixed to the base 22 via the fixing member 32 so that the surface of the substrate 26 on which the antenna portion 42 is formed is approximately perpendicular to the first surface of the base 22 on which the substrate 26 is arranged. That is, the substrate 26 is fixed to the base 22 so that a direction in which a thickness of the substrate 26 extends is approximately perpendicular to the direction in which the thickness of the base 22 extends.

The antenna unit 30 is arranged in the case 34. As described above, the case 34 configures the protruded portion of the outer surface of the vehicle 10 and is made of resin material. In the present embodiment, the antenna unit 30 is arranged in a space defined by the case 34 and the base 22. Further, the case 34 has a shark-fin shape.

The antenna apparatus 20 according to the present embodiment further includes thermal conductive members 36. The thermal conductive member 36 is contacted with an inner surface of the case 34 and a surface of the circuit portion 28 positioned opposite to the opposing surface 28*a* of the circuit portion 28. The thermal conductive member 36 is made of material having a thermal conductivity higher than air. The thermal conductive member 36 configures a heat transfer path between the circuit portion 28 and the case 34. In the present embodiment, the thermal conductive member 36 is made of copper. The thermal conductive member 36 is attached to the circuit portion 28 on the surface that is positioned opposite to the opposing surface 28*a* of the circuit portion. That is, the thermal conductive member 36 is attached to the antenna unit 39. The antenna unit 30 to which the thermal conductive member 36 is attached is inserted to the case 34 so that thermal conductive member 36 is contacted with the inner surface of the case 34.

Hereinafter, a coupling strength of the coupling member 50 arranged between the electrodes 52 of the circuit portion 28 and the antenna portion 42 is referred to as a first coupling strength. A coupling strength of the thermoplastic resin layer 46 arranged between the opposing surface 28*a* of the circuit portion 28 and the opposing surface of the substrate 26 is referred to as a second coupling strength. A coupling strength of the heat transfer path arranged between the circuit portion 28 and the case 34 is referred to as a third coupling strength. In the present embodiment, the first coupling strength is larger than the second coupling strength, and the second coupling strength is larger than the third coupling strength. Further, the third coupling strength between the circuit portion 28 and the case 34 includes a first sub coupling strength exiting between the case 34 and the thermal conductive member 36 and a second sub coupling strength existing between the circuit portion 28 and the thermal conductive member 36. In the present embodiment, the third coupling strength is set as the lower coupling strength between the first sub coupling strength and the second sub coupling strength.

The following will describe a manufacturing method of the antenna unit 30 with reference to FIG. 4.

Figure 4A:
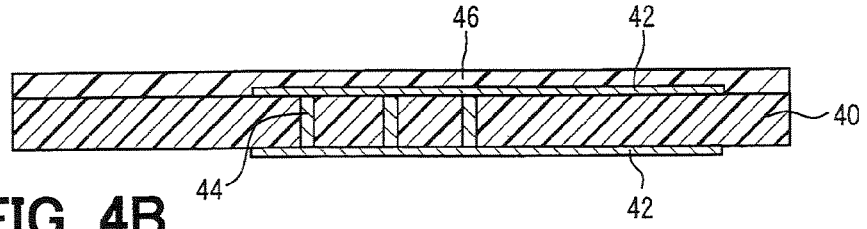
FIG. 4A to FIG. 4D are diagrams showing a manufacturing method of the antenna unit.

First, the base layer 40 on which the antenna portion 42 is arranged is prepared. As shown in FIG. 4A, in the present embodiment, the antenna portion 42 is arranged on both surfaces of the base layer 40. Thus, the base layer 40, which has the antenna portion 42 on both surfaces, is prepared. Then, the thermoplastic resin layer 46 is bonded to the first surface of the base layer 40 so that the antenna portion 42 is covered by the thermoplastic resin layer 46. As described above, the thermoplastic resin layer 46 is softened and is bonded to the first surface of the base layer 40 by the thermocompression bonding under the predetermined temperature. At the predetermined temperature, the thermal decomposition does not occur in the base layer 40. In the present embodiment, the thermoplastic resin layer 46 is provided by the polyetherimide, and is bonded to the base layer 40 within a temperature range of 220 degrees Celsius (° C.) to 260° C. by the thermocompression bonding.

Figure 4B:
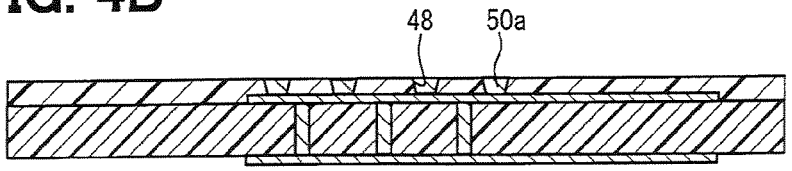

As shown in FIG. 4B, the through-holes 48 are defined at the predetermined positions of the thermoplastic resin layer 46 by carbon dioxide laser. Then, the through-holes 48 are filled with conductive paste 50*a*. The conductive paste 50*a* is sintered to form the coupling member 50. The conductive paste 50*a* is obtained by kneading and mixing conductive particles with organic solvent, such as terpineol. In the present embodiment, conductive paste 50*a* includes conductive particles in which Ag powder including Ag particles and Sn powder including Sn particles are mixed at a predetermined ratio. Further, when a weight ratio of the Ag particles in the conductive particles is within a range of 60% to 73%, a balance between a conductive property and a bonding property is improved. In the present embodiment, the conductive particles include Sn particles having a weight ratio of 65% and Ag particles having a weight ratio of 35%. Further, the terpineol having a weight ratio of 5% to 6% to the conductive particles is added to the conductive particles as the organic solvent to form the conductive paste 50*a*. The conductive particles may include Cu particles other than Ag particles and Sn particles. Further, glass frit having a low melting point, binder, such as organic resin, and inorganic filler may be added to the conductive paste 50*a*.

Figure 4C:
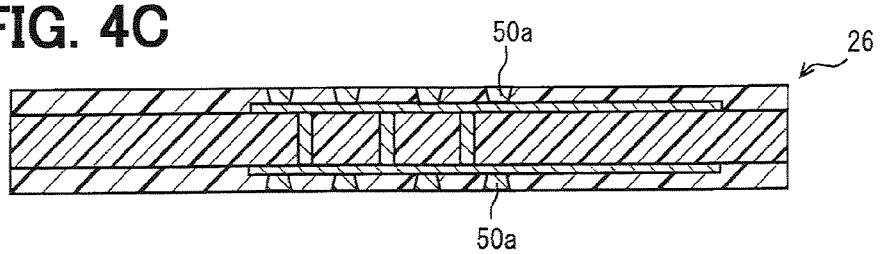
Figure 4D:
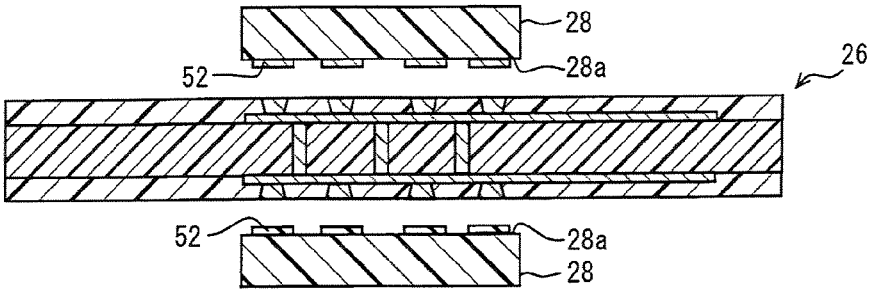

As shown in FIG. 4C, thermoplastic resin layer 46 is bonded to the second surface of the base layer 40 so that the antenna portion 42 arranged on the second surface is covered by the thermoplastic resin layer 46. Further, through-holes 48 are defined at predetermined positions of the thermoplastic resin layer 46 bonded to the second surface of the base layer 40. Then, through-holes 48 are filled with the conductive paste 50*a*. With above-described processes, the substrate 26 having the conductive paste 50*a* to be sintered is formed.

Then, the circuit portion 28 is pressed toward the substrate 26 under a condition that the opposing surface 28*a* of the circuit portion 28 on which the electrodes 52 are arranged is being heated by a thermocompression bonding tool. For example, the thermocompression bonding tool may be provided by a pulse heating thermocompression bonding tool. Specifically, the circuit portion 28 is pressed toward the thermoplastic resin layer 46 and is being heated at a temperature under which the thermoplastic resin layer 46 is softened. For example, the temperature may be set within a range of 220° C. to 260° C. Under the heating process and the pressing process, Ag particles and Sn particles are sintered to form the coupling member 50 that is made of Ag—Sn alloy mainly including $Ag_3Sn$. That is, the coupling member 50 is made of sintered Ag powder and sintered Sn powder. Further, a melting point of $Ag_3Sn$ formed by the sintering is 480° C. Further, the solid phase diffusion layer is formed on the boundary face between the coupling member 50 and the antenna portion 42 by a solid phase diffusion bonding of excessive Sn particles included in the coupling member 50 with Cu particles included in the antenna portion 42. Further, the solid phase diffusion layer is formed on the boundary face between the coupling member 50 and the electrodes 52 of the circuit portion 28 by a solid phase diffusion bonding of excessive Sn particles included in the coupling member 50 with Ni particles included in the electrodes 52 of the circuit portion 28.

The softened thermoplastic resin layer 46 flows under the press transmitted from the circuit portion 28 and adheres to the opposing surface 28*a* of the circuit portion 28, the electrodes 52 of the circuit portion 28, and the coupling member 50. As shown in FIG. 3, an electrical coupling portion provided by the coupling member 50 between the circuit portion 28 and the antenna portion 42 is sealed by the thermoplastic resin layer 46. With above-described processes, the antenna unit 30 is formed.

The following will describe advantages provided by the antenna apparatus 20.

In the present embodiment, the circuit portion 28 is mounted on the substrate 26 having the antenna portion 42. That is, the antenna portion 42 is arranged adjacent to the circuit portion 28. Thus, when the utilized radio waves are within a high frequency range, such as several GHz, the transmission loss due to the high frequency range of the radio waves is restricted by the arrangement of antenna portion 42 adjacent to the circuit portion 28. Thus, a performance of the antenna apparatus 20 is improved when used in the vehicle-to-vehicle communication and the road-to-vehicle communication.

Figure 5:
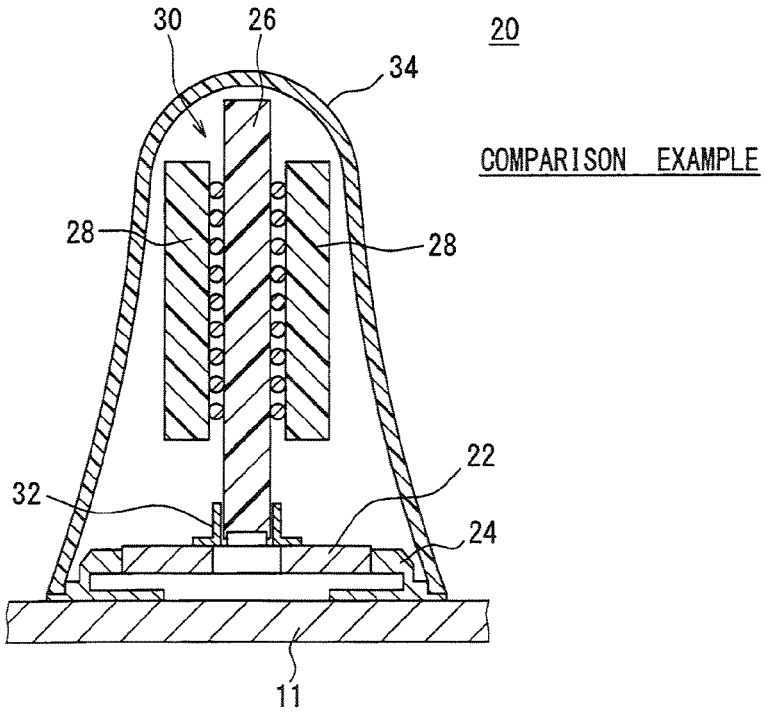
FIG. 5 is a diagram showing a cross-sectional view of a vehicular antenna apparatus according to a first comparison example.

As shown in FIG. 5, a first comparison example of the antenna apparatus 20 does not include the thermal conductive member 36. Thus, in the first comparison example, when the circuit portion 28 is mounted on the substrate 26, heat generated at the circuit portion 28, for example, heat generated by the power amplifier included in the circuit portion 28 is transferred to the case 34 via the air between the case 34 and the circuit portion 28. Thus, heat release efficiency from the circuit portion 28 to the case 34 is low. As shown in FIG. 2, in the present embodiment, the thermal conductive member 36 having the thermal conductivity higher than air is arranged between circuit portion 28 and the case 34, and functions as the heat transfer path. With the heat transfer path, the heat generated at the circuit portion 28 is transferred from the circuit portion 28 to the case 34 at a high efficiency even when the circuit portion 28 is arranged in the case 34. Then, the case 34 is cooled by an airflow generated during a running of the vehicle 10. Thus, a performance degradation of the circuit portion 28 caused by temperature increase is restricted without installing a cooling fun or opening a vent hole. That is, the performance degradation of the circuit portion 28 is restricted and a design characteristic is secured.

Figure 6:
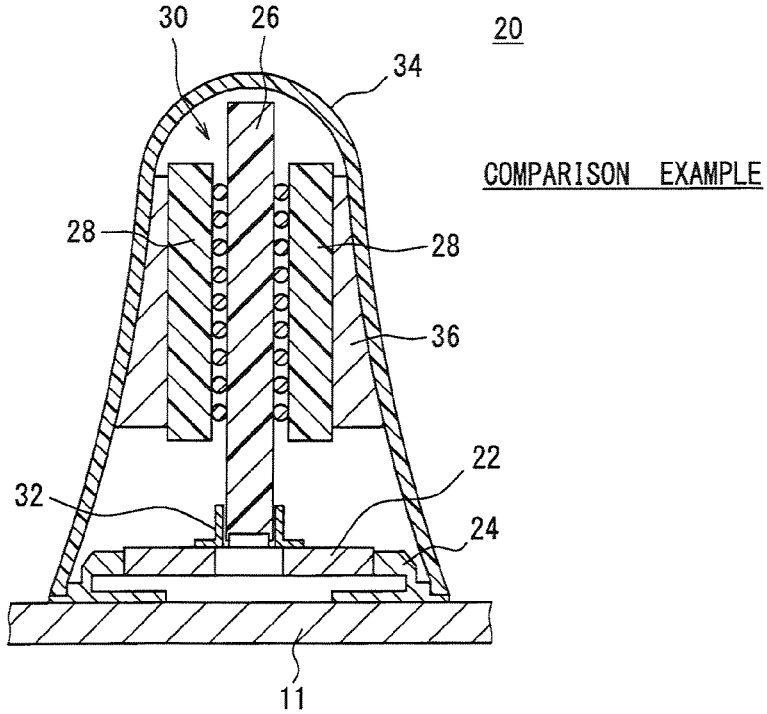
FIG. 6 is a diagram showing a cross-sectional view of a vehicular antenna apparatus according to a second comparison example.

In the substrate 26 to which the circuit portion 28 is attached, the electrical coupling portion between the circuit portion 28 and the antenna portion 42 is subjected to a thermal stress from a usage environment, a vibration of the vehicle 10, a force of wind during the running of the vehicle, a stress generated in assembling of the substrate 26 to the case 34. FIG. 6 shows a second comparison example of the antenna apparatus 20 in which the thermal conductive member 36 is arranged. In the antenna apparatus 20 shown in FIG. 6, the circuit portion 28 is electrically coupled with the antenna portion 42 via solder. Similar to the antenna apparatus 20 according to the present embodiment, in the antenna apparatus shown in FIG. 6, a coupling portion between the circuit portion 28 and the substrate 26 is subjected to the stress generated by installing the substrate 26 to the case 34 by, for example, inserting and the like. The stress applied to the coupling portion increases with an increase of the assembly variation of the antenna unit 30 to the case 34. Further, after the assembling of the antenna unit 30 to the case 34, the coupling portion is subjected to a stress due to an arrangement in which the circuit portion 28 is sandwiched by the case 34 and the substrate 26. Further, the vibration of the vehicle 10 is applied not only to the substrate 26, but also to the coupling portion via the case 34. Further, a stress generated by a difference between a coefficient of linear expansion of the case 34 and a coefficient of linear expansion of the substrate 26 is applied to the coupling portion. The stress generated by the difference in the coefficient of linear expansion is also known as a thermal stress. Thus, as shown in FIG. 6, when the circuit portion 28 is electrically coupled to the antenna portion 42 via solder, the solder functions as the coupling portion and a lifetime of the coupling portion is less likely to be secured. Generally, a Young's modulus of eutectic solder is around 22 gigapascals (GPa), and a Young's modulus of lead-free solder is around 25 to 40 GPa. In FIG. 6, the circuit portion 28 is a ball grid array (BGA) type surface-mount packaging.

In the present embodiment, the coupling member 50, which electrically couples the circuit portion 28 with the antenna portion 42, is made of Ag—Sn alloy mainly including $Ag_3Sn$. A Young's modulus of $Ag_3Sn$ is around 75 GPa when a tension environment temperature is equal to a room temperature. When the tension environment temperature is equal to 100° C., a Young's modulus of $Ag_3Sn$ is around 60 GPa. When the tension environment temperature is equal to 150° C., a Young's modulus of $Ag_3Sn$ is around 52 GPa. As described above, the coupling member 50 in the present embodiment is more rigid compared with the solder, and is less likely to be deformed or distorted under the stress. Further, the solid phase diffusion layer is formed on the boundary face between the coupling member 50 made of Ag—Sn alloy and the antenna portion 42. In this solid phase diffusion layer, Cu and Sn are mutually diffused to form the Cu—Sn alloy layer as the solid phase diffusion layer. Further, the solid phase diffusion layer is formed on the boundary face between the coupling member 50 made of Ag—Sn alloy and the electrodes 52 of the circuit portion 28. In this solid phase diffusion layer, Ni and Sn are mutually diffused to form the Ni—Sn alloy layer as the solid phase diffusion layer. As described above, the solid phase diffusion layer formed between the circuit portion 28 and the coupling member 50 and the solid phase diffusion layer formed between the antenna portion 42 and the coupling member 50 are less likely to be deformed compared with the solder, which is liquid phase diffusion. Thus, the lifetime of the coupling member 50 between the antenna portion 42 and the circuit portion 28 is improved even under a configuration in which the coupling member 50 is easily subjected to a stress caused by the heat transfer path arranged between the circuit portion 28 and the case 34.

In the present embodiment, the antenna apparatus 20 includes the base 22 that is attached to the roof 11 of the vehicle 10. Further, the substrate 26 is arranged on the base 22 in a standing manner, and the substrate 26 and the circuit portion 28 are housed in the space defined by the base 22 and the case 34. Further, the heat transfer path is formed between the circuit portion 28 and the case 34, and the heat transfer path is separate from the base 22.

When the antenna apparatus 20 is arranged on the roof 11 of the vehicle 10, radiated solar heat generated on the roof 11 is transferred to the base 22. The heat transferred to the base 22 is further transferred to the circuit portion 28 via the substrate 26. Further, the heat is released from the base 22 to the space defined by the base 22 and the case 34. Thus, a temperature of the circuit portion 28 may easily increase. Further, the heat transferred from the base 22 is accumulated in the space defined by the base 22 and the case 34. That is, the circuit portion 28 is exposed to a high-temperature environment. In the present embodiment, the thermal conductive member 36 is arranged between the circuit portion 28 and the case 34. With this configuration, the heat transfer path having the thermal conductivity higher than air is formed between the circuit portion 28 and the case 34. Thus, the heat can be released from the circuit portion 28 to the case 34 via the heat transfer path. That is, the performance degradation of the circuit portion 28 due to the temperature increase is restricted and the design characteristic is secured.

In the present embodiment, the circuit portion 28 is mounted on the substrate 26 so that the circuit portion 28 is apart from the base 22 in the direction perpendicular to the first surface of the base 22. With this configuration, the radiated solar heat transferred from the base 22 to the circuit portion 28 is reduced. Thus, the performance degradation of the circuit portion 28 due to the temperature increase is restricted.

In the present embodiment, the circuit portion 28 includes the power amplifier, which generates largest amount of heat in the wireless communication circuit. However, as described above, the heat transfer path having the thermal conductivity higher than air is formed between the circuit portion 28 and the case 34. Thus, the performance degradation of the circuit portion 28 is restricted even when the circuit portion 28 includes the power amplifier.

In the present embodiment, the substrate 26 includes the thermoplastic resin layer 46 arranged opposed to the circuit portion 28. The substrate 26 is attached to the circuit portion 28 via the thermoplastic resin layer 46. Further, as described above, the electrodes 52 of the circuit portion are mechanically and electrically coupled to the antenna portion 42 of the substrate 26 via the coupling member. Thus, a coupling portion mechanically coupling the substrate 26 with the circuit portion 28 includes the coupling member 50 and the thermoplastic resin layer 46 sandwiched between the substrate 26 and the circuit portion 28. With this configuration, a mechanical coupling strength of the coupling portion between the antenna portion 42 of the substrate 26 and the circuit portion 28 is increased. Accordingly, a lifetime of the coupling portion between the circuit portion 28 and the substrate 26 is increased. Further, the coupling member 50, which functions as the electrical coupling portion, is disposed in the through-hole portion 48 extending through the thermoplastic resin layer 46 in order to electrically couple the circuit portion 28 with the antenna portion 42. The electrical coupling portion is sealed by the thermoplastic resin layer 46. Since the electrical coupling portion is protected from the outside by the thermoplastic resin layer 46, the lifetime of the electrical and mechanical coupling portion provided by the coupling member 50 is increased. Further, as described above, the sealing and the electrical coupling is performed in the same process. Thus, manufacturing process is simplified.

In the present embodiment, as described above, the first coupling strength is larger than the second coupling strength, and the second coupling strength is larger than the third coupling strength. Thus, when a stress is applied to the circuit portion 28, the coupling provided by the heat transfer path between the circuit portion 28 and the case 34 is decoupled. Then, a surface of thermoplastic resin layer 46 attached to the opposing surface 28*a* of the circuit portion 28 is subjected to the stress, and a spelling or a crack is formed on the surface of the thermoplastic resin layer 46. Thus, the electrical coupling provided by the coupling member 50 between the circuit portion 28 and the antenna portion 42 is secured.

Figure 7:
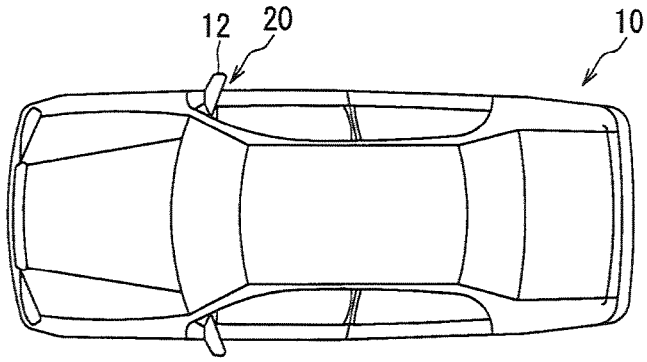
FIG. 7 is a diagram showing an attachment position of a vehicular antenna apparatus according to a first modification of the present disclosure.

In the present embodiment, the antenna apparatus 20 is attached to the roof 11 of the vehicle 10. That is, the case 34, which configures the protruded portion of the outer surface of the vehicle 10, is arranged on the roof 11 and provides a case of the antenna apparatus 20. Alternatively, the antenna apparatus 20 may be arranged in a different manner other than the above-described manner. For example, as shown in FIG. 7, the antenna apparatus 20 may be attached to a side mirror 12 of the vehicle 10. In this configuration, the antenna apparatus 20 may include at least the substrate 26 including the antenna portion 42, the circuit portion 28 mounted on the substrate 26, and the case 34. Further, the case 34 is provided by a case of the side mirror 12.

Figure 8:
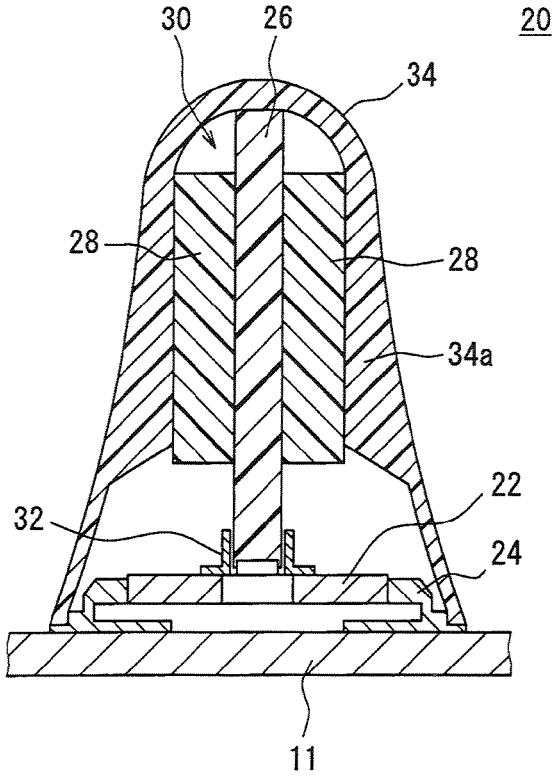
FIG. 8 is a diagram showing a configuration of a vehicular antenna apparatus according to a second modification of the present disclosure.

In the present embodiment, the thermal conductive member 36 made of Cu is arranged between the circuit portion 28 and the case 34 as the heat transfer path. The heat transfer path may be provided by another thermal conductive member. For example, the heat transfer path may be provided by a thermal conductive member 36 made of rubber material, resin material, or gel material. Further, the thermal conductive member 36 may include multiple sub members other than single member. Further, as shown in FIG. 8, the heat transfer path may be provided by a configuration in which the circuit portion 28 is directly contacted to the inner surface of the case 34 without the thermal conductive member 36. As shown in FIG. 8, the case 34 includes a thick wall portion 34*a*. The circuit portion 28 is inserted in the case 34 so that the circuit portion 28 is contacted with the thick wall portion 34*a* of the case 34. Further, the thick wall portion 34*a* may be at least arranged at a predetermined part of the case 34, which faces the circuit portion 28.

In the present embodiment, the substrate 26 includes the thermoplastic resin layer 46, the through-hole portion 48, and the coupling members 50. Further, when the circuit portion 28 includes a printed substrate, the circuit portion 28 may include the thermoplastic resin layer 46, the through-hole portion 48, and the coupling members 50. That is, one of the substrate 26 and the circuit portion may include the thermoplastic resin layer 46, the through-hole portion 48, and the coupling members 50.

In the present embodiment, the circuit portion 28 is mounted on the substrate 26 so that the circuit portion 28 is apart from the base 22. Further, the circuit portion 28 may be mounted on the substrate 26 not limited by a mounting position with respect to the base 22. For example, the circuit portion 28 is mounted on the substrate 26 so that the circuit portion 28 is contacted with the base 22. However, a configuration in which the circuit portion 28 is mounted on the substrate 26 so that the circuit portion 28 is apart from the base 22 provides above-described advantages.

In the foregoing embodiments, the antenna portion 42 is provided by the antenna, which is used for the vehicle-to-vehicle communication and works within a frequency range of 5.9 GHz band. Further, the frequency range of the utilized radio waves of the antenna portion 42 is not limited to 5.9 GHz, and the usage of the antenna portion 42 is not limited to the vehicle-to-vehicle communication.

While only the selected exemplary embodiments have been chosen to illustrate the present disclosure, it will be apparent to those skilled in the art from this disclosure that various changes and modifications can be made therein without departing from the scope of the disclosure as defined in the appended claims. Furthermore, the foregoing description of the exemplary embodiments according to the present disclosure is provided for illustration only, and not for the purpose of limiting the disclosure as defined by the appended claims and their equivalents.

What is claimed is:

1. A vehicular antenna apparatus comprising:

a substrate having an antenna portion;

a circuit portion mounted on the substrate and configuring at least a part of a wireless communication circuit that is electrically coupled with the antenna portion;

a case made of resin material and configuring a protruded portion of an outer surface of a vehicle, the substrate and the circuit portion being arranged in the case; and a heat transfer path arranged between the circuit portion and the case, the heat transfer path having a thermal conductivity higher than air, wherein the circuit portion is electrically coupled with the antenna portion by a solid phase diffusion bonding.

2. The vehicular antenna apparatus according to claim 1, further comprising a base attached to a roof of the vehicle, wherein the substrate is arranged on the base in a standing manner, wherein the substrate and the circuit portion are housed in a space defined by the base and the case, and wherein the heat transfer path is arranged between the circuit portion and the case and is separated from the base.

3. The vehicular antenna apparatus according to claim 2, wherein the circuit portion is mounted on the substrate so that the circuit portion is apart from the base in a direction perpendicular to a surface of the base on which the substrate is arranged.

4. The vehicular antenna apparatus according to claim 1, wherein the circuit portion includes a power amplifier that amplifies a signal to be transmitted.

5. The vehicular antenna apparatus according to claim 1, wherein one of the substrate and the circuit portion includes a thermoplastic resin layer arranged opposed to the other one of the substrate and the circuit portion, wherein the thermoplastic resin layer defines a through-hole portion extending from the substrate to the circuit portion, and a coupling member that electrically couples the circuit portion with the antenna portion is arranged in the through-hole portion as an electrical coupling portion, wherein the substrate includes a surface positioned opposed to a surface of the circuit portion, wherein the surface of the substrate and the surface of the circuit portion are attached with each other via the thermoplastic resin layer, and wherein the electrical coupling portion between the circuit portion and the antenna portion is sealed by the thermoplastic resin layer.

6. The vehicular antenna apparatus according to claim 5, wherein a coupling strength of the coupling member between the circuit portion and the antenna portion is referred to as a first coupling strength, wherein a coupling strength of the thermoplastic resin layer between the surface of the substrate and the surface of the circuit portion is referred to as a second coupling strength, wherein a coupling strength of the heat transfer path between the circuit portion and the case is referred to as a third coupling strength, and wherein the first coupling strength is larger than the second coupling strength, and the second coupling strength is larger than the third coupling strength.

7. The vehicular antenna apparatus according to claim 5, wherein the coupling member is made of sintered silver powder and sintered tin powder.

* * * * *